US005222264A

United States Patent [19]

Morry

[11] Patent Number: 5,222,264

[45] Date of Patent: Jun. 29, 1993

[54] MATTRESS CONSTRUCTION

[75] Inventor: Slateon N. Morry, Manitoba, Canada

[73] Assignee: Regal Bedding 1977 Limited, Winnipeg, Canada

[21] Appl. No.: 883,769

[22] Filed: May 15, 1992

[51] Int. Cl.[5] ..... A47C 27/04

[52] U.S. Cl. ..... 5/475; 5/481; 267/81; 267/95

[58] Field of Search ..... 5/481, 475, 474, 464, 5/246, 248, 256; 267/33, 81, 91, 95

[56] References Cited

U.S. PATENT DOCUMENTS

| | | | |
|---|---|---|---|
| 1,325,874 | 12/1919 | Krakauer | 5/475 |
| 1,936,389 | 11/1933 | Hallquist | 267/33 |
| 3,145,020 | 8/1964 | Calla . | |
| 3,401,411 | 9/1968 | Morrison . | |
| 4,052,760 | 10/1977 | Golembeck | 5/475 |
| 4,154,786 | 5/1979 | Plasse . | |
| 4,161,046 | 7/1979 | Golembeck | 5/464 |
| 4,862,540 | 9/1989 | Savenije . | |
| 4,866,779 | 9/1989 | Glackin | 5/475 |
| 5,020,854 | 6/1991 | Marion . | |

FOREIGN PATENT DOCUMENTS

| | | | |
|---|---|---|---|
| 435149 | 6/1948 | Canada . | |
| 449744 | 7/1948 | Canada . | |
| 967294 | 5/1975 | Canada . | |
| 2049132 | 9/1992 | Canada . | |
| 3831510 | 5/1989 | Fed. Rep. of Germany | 5/475 |
| 67932 | 6/1955 | France | 5/475 |
| 8101008 | 10/1982 | Netherlands | 5/475 |
| 2052677 | 1/1981 | United Kingdom | 267/33 |
| 2215199 | 9/1989 | United Kingdom | 5/475 |

*Primary Examiner*—Peter M. Cuomo
*Assistant Examiner*—F. Saether
*Attorney, Agent, or Firm*—Adrian D. Battison; Stanley G. Ade; Murray E. Thrift

[57] ABSTRACT

A conventional mattress construction which includes a series of interconnected BONNEL type coil springs together with top and bottom covering layers of fabric and padding is modified by the insertion into some of the coils of a circular cylindrical core member formed from foam which has a length greater than the length of the spring so that ends of the core member project outwardly beyond the end of the springs into engagement with the padding on the top and bottom surfaces of the mattress. The core member has a diameter which is a friction fit with the inside diameter of the intermediate turns of the spring. The core members are provided preferably in the center third of the mattress to increase stiffness in that area and to reduce vibrations being transmitted from one occupant to a second occupant.

1 Claim, 3 Drawing Sheets

MATTRESS CONSTRUCTION

BACKGROUND OF THE INVENTION

This invention relates to a mattress construction and particularly to an arrangement for providing greater spring resistance in parts of the mattress and to an upholstery construction for use in construction of mattresses and the like.

One type of mattress is formed substantially from interconnected springs so as to form a spring array of helical coiled springs interconnected in columns and rows with the axis of the spring transverse to the array. The spring array thus provides the resistance to compression width wise of the mattress that is in the direction transverse to the array. The array thus forms a first planar surface on one face and a second planar surface on the opposed face. Over the first and second surfaces are applied firstly a layer of a scrim material which engages the end faces of the springs. On top of the scrim material is provided a resilient layer sometimes a foam and sometimes of a felted cotton material. Outside the resilient layer is applied a quilted outer covering which generally covers both the first and second surfaces and extends around the sides of the array to encase the whole mattress.

As is well known in the art, many different types of materials are used for the individual layers and these can be selected accordingly.

In one type of spring array construction, the individual coil springs are shaped with an end turn of the wire forming the coil spring of larger diameter than the plurality of intermediate turns to form in effect an hour glass shape. This type of coil is known as a BONNEL coil and is widely used in the upholstery art.

These coils are then connected together at the points of contact between each spring and the four adjacent springs in the adjacent columns and rows. Each connection is made by a helical coupling element which is threaded around the adjacent points of the end turns of the springs. Thus each helical coupling element extends across the full width of the mattress and wraps around the adjacent spring of two rows. Each end turn is therefore connected to the end turn of the next adjacent spring by an inextensible wire member which holds the end turns together in a common plane.

Another type of spring construction is called a pocket spring in which each spring is of the simple constant diameter helical type and is received within a fabric pocket. The pockets are then sewn together in the planar array with the fabric pockets holding each spring close to or in contact with its next adjacent springs.

In recent years the trend has been toward an increasing stiffness of the mattress that is an increase in the resistance to compression along the springs. In one example this is achieved by the attachment of elastic straps across the mattress generally in the central third of the mattress which is known to take the majority of the weight of the user when lying on the mattress. A number of the straps are therefore attached across the mattress and have ends attached to the side wires of the mattress so that the elastic straps tend to resist compression of the mattress in this area.

An alternative technique which has been employed is that of inserting rectangular strips of foam material into the space between each spring and the next adjacent spring. Thus the foam material has a width equal to the spacing between the intermediate turns of the coils and a height slightly less than the height of the coils so that it can be received under the end turn and outside the intermediate coils.

This technique has achieved little commercial success and has little technical effect since the resilience of the foam does not significantly add to the spring resistance of the wire springs.

Canadian Patent 449744 discloses an arrangement for assisting a spring of the Bonnel coil type at its position of maximum compression. The patent discloses the provision of a square cross section elongate core which is inserted into the spring and has a length substantially equal to the length of the spring. The dimension of the square cross section is such that the diagonal is slightly greater than the diameter of the intermediate coils of the spring so that the core is compressed at its point of engagement with the intermediate turns and bulges out between the intermediate turns. In the dimension at right angles to the sides of the core, the sides are spaced away from the inside of the spring since that dimension is less than the diameter of the spring. This core is formed of a resilient foam material and is stated to preclude total collapse of the spring and to arrest the action of the spring only when it becomes for the most part fully compressed. This core is therefore used in a situation where the spring is intended to be compressed vigorously for example in a car seat when used by a heavy occupant. The core has little effect at the normal expanded position of the spring and only begins to have its effect when the spring is substantially fully compressed.

In the situation of a mattress of the above type, full compression of the spring almost never occurs. The spring is intended to operate only in a very small range from the fully expanded position to a slightly compressed position. The above patent is therefore of little relevance to the construction of a mattress.

Another arrangement of upholstery construction is shown in a number of patents for example U.S. Pat. No. 3,401,411 (Morrison); U.S. Pat. No. 4,154,786 (Plasse); U.S. Pat. No. 4,862,540 (Savenije); U.S. Pat. No. 5,020,852 (Marion); U.S. Pat. No. 3,145,020 (Calla); Canadian 449,744 (Groom); Canadian 435,149 (Marsack); Canadian 2,013,169 (Reinhardt); Canadian 1,213,381 (Savenije); Canadian 967,294 (Frey). In this construction the mattress or other upholstery element is effectively formed of foam and particularly a subsantially solid block of foam with the foam forming the upper and lower surfaces and providing the majority of the resistance to compression. However the above patents have realized the desirability of embedding spring coils in the foam to assist in the resistance to compression. In some cases a circular cylindrical slot is formed in the foam and a coil inserted into the slot. In other cases the same construction is provided by separate foam pieces including a cylindrical core which is inserted inside the spring. However such a construction is effectively related to manufacture of products from foam with a spring assist and is therefore irrelevant to the above mattress construction using the coupled spring array.

SUMMARY OF THE INVENTION

It is one object of the present invention, therefore, to provide an improved mattress construction.

In general terms the invention provides a mattress construction including a spring array which is formed substantially wholly of the springs connected together so that the springs lie side by side in the array generally in rows and columns. In some only of the springs is inserted a core member in the form of a circular cylindrical foam body which has an uncompressed length greater than that of the spring so that it projects outwardly from both ends of the spring. The outside diameter of the cylindrical foam body is substantially equal to that of the inside diameter of the minimum diameter turns of the coil so that it touches all of the intermediate turns of the coil to dampen vibrations. The core is of relatively stiff foam so that it can be inserted into the spring by rotation which acts to screw it into position by cooperation with the helical turns of the spring.

The foam core member is separate from the resilient layers provided on the top and bottom surfaces of the mattress so that it acts as a separate compressible body.

Preferably the core membrs are inserted into a limited number of the coil springs particularly in alternate rows across a centre section of the mattress where it is required conventionally that the mattress be stiffened to receive the majority of the weight of the user.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
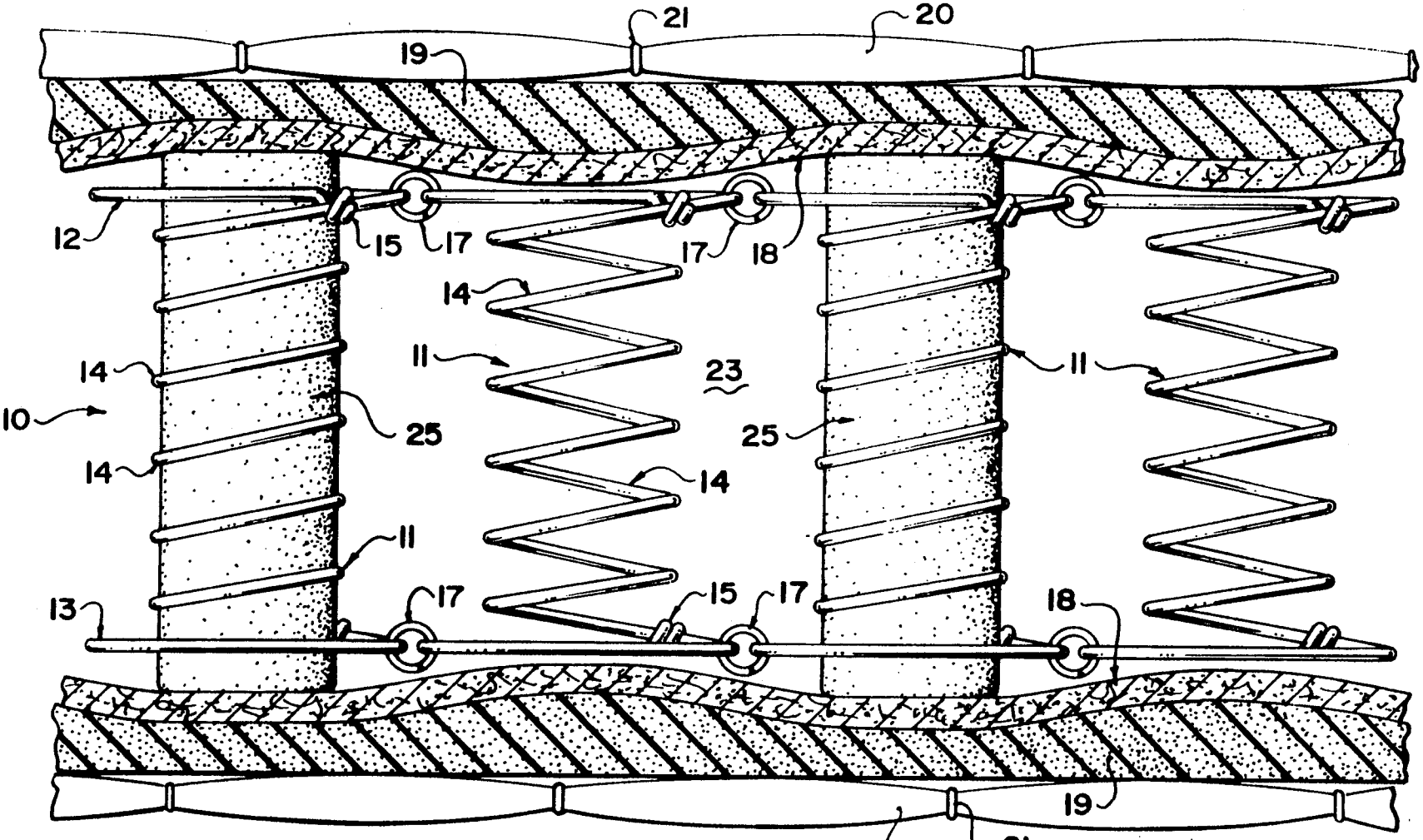
FIG. 1 is a cross sectional view through a mattress showing four rows across the bed of the spring array with the springs and core members therein shown in side elevation.

A mattress comprises a spring array generally indicated at 10 which comprises a plurality of individual springs 11 formed into the array of columns and rows with the periphery of the array being generally rectangular.

Each spring is of the Bonnel type so as to include at each end a turn 12, 13 of increased diameter and a plurality of intermediate turns 14 of reduced diameter generally approximately one half of the diameter of the end turns 12 and 13. The spring is thus formed by a coil of wire which is twisted into the helical coil as shown with the larger end turns, the intermediate turns of constant diameter and a larger end turn at the opposed end. The end of the wire is then cut and knotted or coiled as indicated at 15 around an adjacent portion of the wire. Thus each end turn is formed from 360° of the wire so that at the knot or coil 15 the wire then curves inwardly as indicated at 16 to the diameter of the intermediate turns 14. Following bending to the required shape, the spring is tempered by the application of heat and this is often carried out by applying electrical current through the spring wire which heats the wire to the required temperature for tempering. Conventionally the spring has six turns but this of course may be increased or decreased in accordance with requirements.

Figure 2:
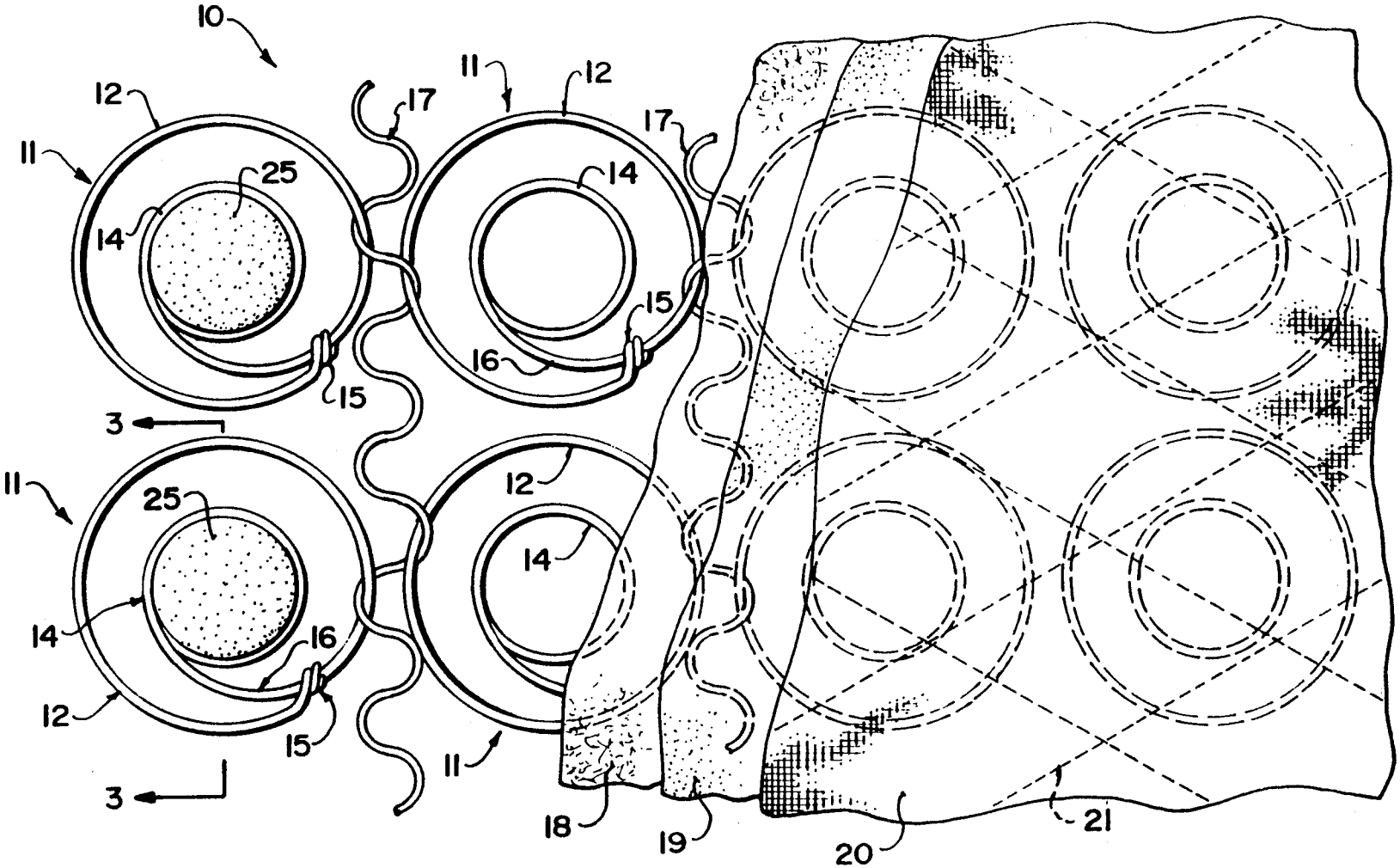
FIG. 2 is a top plan view of the springs of the four rows of FIG. 1 showing the upholstery layers of the mattress partly broken away to expose the top of the springs.

In the conventional system for assembling the array, the springs are formed into the required row and then the row is attached to the next adjacent row by a helical coil 17 of wire which is threaded across the row simply by rotating the helical coil so that it tends to screw itself across the row and to wrap around adjacent portions of the spring as best shown in FIG. 2. The helical connecting wire 17 thus grasps each end turn 12 at its point of closest approach to the next adjacent end turn 12 and wraps around that point to hold the end turn connected together in a manner which prevents their moving apart while allowing a pivotal action of one spring relative to the other. The helical coil 17 is inextensible so that the spacing between the end turns is maintained at a distance less than the diameter of the coil 17.

As shown in FIG. 1, the helical coil 17 are arranged at the end turns 12 and at the opposed end turns 13 so that the end turns 12 form one planar surface of the array and the end turns 13 form a second planar surface of the array spaced by the length of the springs and forming substantially a top and bottom surface of the mattress. The mattress is of course symmetrical so that it can be inverted.

On each of the surfaces of the array is applied a conventional padding arrangement which can vary in the material selected for different qualities, thicknesses and stiffness of the completed mattress construction. In general terms the padding layer on each of the surfaces of the spring array includes a first insulating layer 18 which is of a type having sufficient tensile strength that it can lie over the springs and provide an integral layer which will not tear or break up due to the engagement with or impact with the springs and will not abrade away during the relative movement that is necessary when the springs flex. The materials for this layer can vary and generally comprise a non woven scrim of yarns or fibers. A second layer 19 comprises a resilient layer or padding layer to disguise the individual coils of the springs to prevent the user from feeling those coils when lying on the mattress. The resilient layer 19 can be formed from a layer of a foamed sheet or can comprise a compressed fiber bat. An outermost layer 20 comprises an outer fabric layer having a desired outer fabric pattern which is quilted with suitable thickening or stiffening materials at quilt lines 21.

Figure 4:
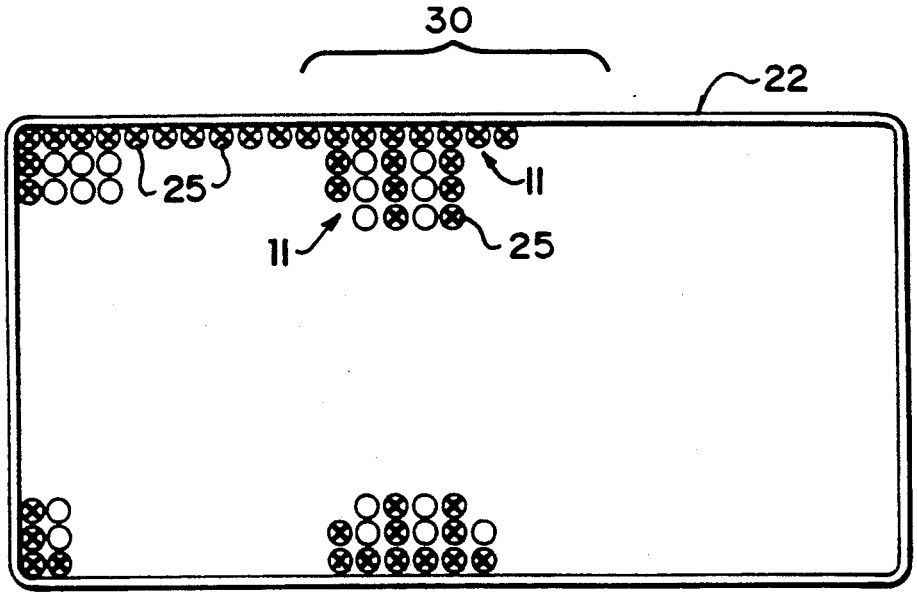
FIG. 4 is a schematic top plan view of a mattress according to the present invention showing schematically a layout of the core members indicated schematically with an X within the spring array of the mattress.

The conventional mattress construction is completed by an edge wire 22 which extends around the periphery of the spring array as shown in FIG. 4. There are two such edge wires each arranged in a respective one of the first and second end planes of the spring array. The edge wires are connected into the spring array by the use of a further helical coil of a type shown at 17. The top and bottom layers covering the planes of the spring array are coupled by side flanges which are clamped to the edge springs following which an outer edge layer of the fabric is attached to provide an attractive edge appearance, the edge fabric being indicated generally at 23 and being attached to the top and bottom layers by a suitable beading arrangement (not shown).

Figure 3:
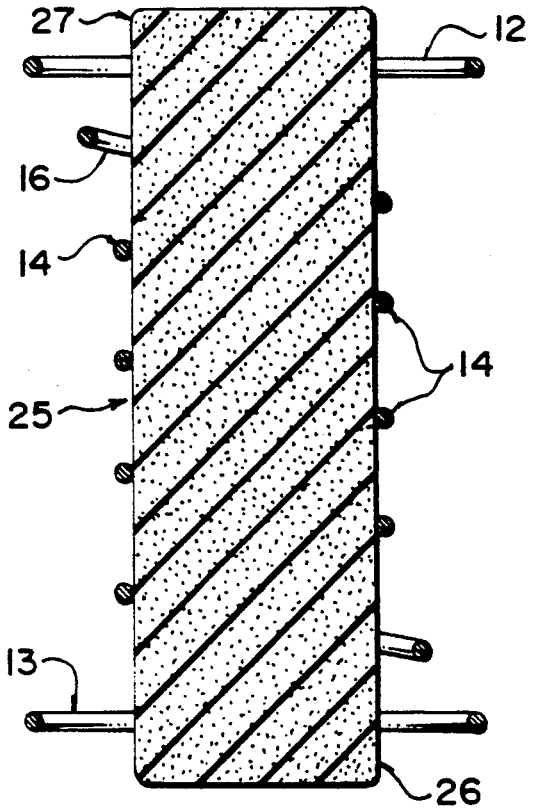
FIG. 3 is a cross sectional view along the lines 3—3 of FIG. 2.

The above construction is substantially conventional and the modification with which the present invention is concerned is that of providing a stiffening effect for some of the individual springs of the spring array. This stiffening effect is provided by a core member 25 in the form of a cylindrical body of circular cross section with that cross section being constant along the full length of the cylindrical body. The body is formed of a relatively stiff foam material. The outside diameter of the cylindrical body is substantially equal to the inside diameter of the intermediate turns of the wire forming the respective coil spring. Thus the core member can be inserted into the spring by pushing the core member into the intermediate turns and then by rotating the core member so that it gradually screws itself along the spring by the cooperation between the helical turns providing a frictional effect on the outside surface of the core member. The diameter is not so great that the core member tends to bulge out between the turns. The diameter is however sufficient that the core member is a friction fit inside the coils of the spring so that it tends to remain fixed in place against axial movement relative to the spring during normal handling. The uncompressed axial length of the core member is greater than that of the spring so that as shown in FIG. 3 the core member projects outwardly beyond each end turn 12, 13 of the spring. The amount of the projection can vary but will preferably lie in the range $\frac{1}{4}$ to $\frac{3}{4}$ inch. The core member thus forms end portions 26 and 27 which projects outwardly beyond the end turn of the spring into engagement with the inside surface of the insulating layer 18. The core member is of course separate from the insulating layer 18 so that forces are applied from the insulating layer 18 onto the core member in a longitudinal direction of the spring. The spring array is apart, from the core members, substantially free from other foam materials so that the majority of the resilience of the spring array is provided by the springs but only a very small proportion provided by the core members as a total of the resilience of all the springs.

With regard to an individual spring of the type having a core member therein, it will be appreciated that on application of an axial load to the spring, assuming that the axial load gradually increases, the first effect will be the compression of the core member so that the end portion of the core member is gradually compressed down toward the end of the spring. Only once the core member has compressed slightly does any compression of the spring commence whereupon the core member and the spring are compressed simultaneously.

With regard to a mattress construction, in view of the complete spring array which is interconnected and therefore cooperates in spring resistance, it is difficult to compress any individual spring down to the nearly flat condition. The core member and the spring therefore cooperate in the range in which the spring is at maximum extent or only slightly compressed and there is little or no effect on the mattress as a whole in relation to a position of maximum compression which rarely occurs. The diameter of the core being substantially to that of the inside turns of the spring also means that the core member projects little if anything as bulges between the turns even when vigorously compressed as an individual spring.

It is generally not intended that all of the springs of the spring array will include the core member as shown. It is generally intended therefore that the core member will only be used where required to provide a stiffening effect for those springs which may receive greater loading. The main intention is therefore to provide the core members in an area which is generally the central third of the mattress generally indicated at 30 which is the area which is known to receive the greatest loading, generally 70%, of the user when resting upon the bed. In addition in some cases the core members may be used around the peripheral springs of the bed to provide a stiffening effect at the edge.

The core members of the present invention therefore provide a unique stiffening effect for selected parts of the mattress by a simple construction which can be readily added to the conventional construction during the manufacturing process after formation of the spring array and prior to the application of the covering layers.

As the core member extends beyond each end of the spring and is supported at both ends by the layers of the mattress and the underlying box spring or other support, the foam core member provides an additional support for those springs in which it is placed so that the spring and core member cooperate at the initial compression of the spring to provide a stiffening effect.

An arrangement of this type thus can increase life of the mattress by reducing the tendancy of the springs to collapse and particularly those springs that receive the maximum load.

The stiffening effect is provided by the individual core members so that the compression at one core member does not affect adjacent core members. In this way there is less tendancy for two occupants of the bed to roll together since the depression caused by one has less tendancy to transmit to the depression caused by the other occupant to form one single depression tending to cause the occupants to roll together.

The separation between the core members and the fact that they touch all of the wires of the intermediate coils tends also to reduce or dampen vibrations in the mattress as a whole caused by one occupant moving so that there is less tendancy for the other occupant to be moved by those vibrations.

An alternative construction of spring array is known as a pocket spring construction in which each individual spring is received within a fabric container following which the fabric containers are stitched together. In this way there is less mechanical interconnection between the springs so they are able to flex more independantly. While not illustrated above, the core member of the present invention can be used also with springs of this type in which the core member is inserted along the length of the spring and preferably extends beyond each of the spring into engagement with the fabric layer and the conventional padding layers on the top and bottom surfaces of the mattress.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A mattress comprising a plurality of coiled wire springs, each coiled helically about a longitudinal axis, means interconnecting the coil springs in a substantially coplanar array with the axes thereof substantially parallel and transverse to the array thus defining a first planar surface of the array at one end of the springs and the second planar surface of the array at an opposed end of the springs parallel to and spaced from the first surface and sides of the array between the first and second surfaces, each of said coiled wire springs having a plurality of turns of wire defining middle ones of the turns having a minimum inside diameter of the turns and defining end ones of the turns of wire of increased diameter relative to the middle ones of the turns to form the spring into a substantially hour glass shape, said interconnecting means arranged to cause the end ones of the turns of wire of one spring to lie immediately adjacent to and substantially in contact with the end ones of the turns of wire of adjacent springs, a first and a second resilient layer each covering and in contact with a respective one of the first and second surfaces of the array, and a fabric covering extending over each of the resilient layers and around the sides of the array, at least some of the spring having inserted therein a core member of a resilient foam material extending along the full length of the respective spring axially of the spring the core member being circular cylindrical so as to define a cylindrical peripheral surface surrounding a longitudinal axis thereof and being continuous along the axis from an end fact at right angles to the axis at one end to an end face at right angles to the axis at an opposed end and having an uncompressed length greater than that of the respective spring and having an uncompressed constant diameter at least equal to said minimum inside diameter so as to define, in an uncompressed state of the core member, a central portion of the core member in contact with the middle ones of the turns of wire of the respective spring and two end portions of the core member projecting axially outwardly from the central portion of the core member, each end portion having said peripheral surface thereof free from contact with and unsupported by a respective one of the end turns of the spring and the core member being separate from the resilient layers and arranged to contact said resilient layers substantially only at said end faces thereof.

* * * * *